United States Patent [19]

Metz

[11] Patent Number: 4,867,038

[45] Date of Patent: Sep. 19, 1989

[54] RECOIL BRAKE FOR A GUN

[75] Inventor: Josef Metz, Neuss, Fed. Rep. of Germany

[73] Assignee: Rheinmetall GmbH, Düsseldorf, Fed. Rep. of Germany

[21] Appl. No.: 231,006

[22] Filed: Aug. 11, 1988

[30] Foreign Application Priority Data

Aug. 27, 1987 [DE] Fed. Rep. of Germany ..... 3728533

[51] Int. Cl.[4] ..... F41F 19/02; F16F 9/10

[52] U.S. Cl. ..... 89/43.01; 89/42.01

[58] Field of Search ..... 89/43.01, 42.01; 188/312–317

[56] References Cited

U.S. PATENT DOCUMENTS

| | | | |
|---|---|---|---|
| 1,004,116 | 9/1911 | Völler | 89/43.01 |
| 1,335,463 | 3/1920 | Schneider | 89/43.01 |
| 1,825,233 | 9/1931 | Joyce | 89/43.01 |
| 2,332,520 | 10/1943 | Lucht | 89/43.01 |
| 3,410,174 | 11/1968 | Hahn | 89/43.01 |
| 3,745,880 | 7/1973 | Metz et al. | 89/43.01 |
| 4,485,722 | 12/1984 | Metz et al. | 89/43.01 |
| 4,502,366 | 3/1985 | Metz et al. | 89/43.01 |
| 4,587,882 | 5/1986 | Metz | 89/43.01 |
| 4,729,280 | 3/1988 | Metz | 89/43.01 |

FOREIGN PATENT DOCUMENTS

| | | |
|---|---|---|
| 220370 | 5/1987 | European Pat. Off. . |
| 423490 | 1/1926 | Fed. Rep. of Germany . |

*Primary Examiner*—David H. Brown

*Attorney, Agent, or Firm*—Spencer & Frank

[57] ABSTRACT

A recoil brake for controlling recoil and counterrecoil movements of a gun includes a brake cylinder; a piston slidably received therein; a hollow piston rod affixed to the piston and arranged for connection to a breechblock of the gun; a throttle passage for braking the motion of the piston; a buffer spear affixed to an end of the brake cylinder and extending within the hollow piston coaxially therewith; and a buffer spear chamber within the piston rod; a throttle sleeve affixed to the piston and extending therewithin, surrounding the buffer spear. The throttle sleeve and the piston rod define an annular inlet channel, while the throttle sleeve and the buffer spear define an annular outlet channel. A check valve is located between the inlet and outlet channels, and it opens solely in response to pressure in the inlet channel when the piston moves in a direction outwardly of the brake cylinder (recoil movement). An axially extending throttle groove is provided in the outer surface of the buffer spear. Further, there is provided an annular guide which is formed on the throttle sleeve and which surrounds and slidingly contacts the buffer spear. The annular guide cooperates with the throttle groove for forming a constricted passage for the hydraulic fluid as it flows from the buffer spear chamber through the outlet channel to one side of the piston as the piston moves into the brake cylinder (counterrecoil movement). Cross-sectional passage areas of the throttle groove along a length thereof determine the extent and the path length of the braking effect for the counterrecoil movement of the gun.

8 Claims, 1 Drawing Sheet

FIG. 2

RECOIL BRAKE FOR A GUN

BACKGROUND OF THE INVENTION

1. Field of the Invention

The present invention relates to a recoil brake for a gun. The recoil brake includes a brake cylinder in which slides a piston having a hollow piston rod. As the piston moves as urged by the recoiling mass, it displaces the hydraulic fluid through a narrow flow cross section to thus brake the recoiling mass. The piston rod and the brake cylinder define a brake chamber formed therebetween. Adjacent the closed end of the piston rod there is defined a counterrecoil buffer spear chamber. The brake cylinder also includes a buffer spear which is fixed to the brake cylinder and which projects into the buffer spear chamber so that during counterrecoil, the buffer spear displaces the hydraulic fluid from the buffer spear chamber through a throttle opening.

2. Discussion of the Prior Art

Published European Patent Application No. 220,370 discloses a recoil brake which can be placed between the cradle and the breechblock of a gun. The brake contains a piston which is slidably disposed in a brake cylinder. The piston is moved by the recoiling gun barrel in a direction outwardly of the brake cylinder and, at the same time, the piston presses the hydraulic fluid through a narrow flow cross section for the purpose of braking the recoiling gun barrel. Thereafter, the gun barrel is moved again forward by a recuperator. During this forward movement of the gun barrel, a buffer spear enters into a buffer spear chamber toward the end of the counterrecoil (forward) movement and displaces the hydraulic fluid from the buffer spear chamber through a throttle opening. This causes damping of the velocity of the counterrecoiling mass to the extent that it is able to enter the firing position without much of an impact. However, a buffer spear of this type is only suitable as a damping means for the end position. In devices where there is firing with different charges such that short recoil paths develop for the small charges, particularly for armored howitzers equipped for an automatic flow of ammunition, the volume of the buffer spear chamber may not be filled sufficiently with hydraulic fluid so that the counterrecoil movement lacks a defined course of velocity. Such a defined velocity course is necessary to manage control processes for ammunition flow components such as the primer supply or a ramming device.

German Patent No. 423,490 discloses a device which combines a recoil brake and a recuperator mechanism. This device provides braking and counterrecoil grooves which have a steadily changing flow cross section. These grooves are disposed parallel to one another on the interior of a sleevetype regulator for braking the gun barrel recoil over the entire length of the gun barrel recoil so as to realize a uniform recuperation velocity. Upon counterrecoil, a predominantly uniform counterrecoil velocity is achieved by throttling the hydraulic fluid in the region of the counterrecoil grooves. However, this device is subject to malfunction due to wear of the valve seats, and has the further drawback that it requires a structural length of at least twice the gun barrel recoil length. The device requires this length to enable the piston to enter, during braking, into a further cylinder chamber corresponding to the recoil length of the gun barrel in order to displace the hydraulic fluid.

SUMMARY OF THE INVENTION

It is an object of the present invention to provide an improved recoil brake of the above-discussed type which, by virtue of a simple construction, has a defined velocity curve over a counterrecoil path of substantial length before the end of the counterrecoil movement.

This object and others to become apparent as the specification progresses, are accomplished by the invention, according to which, briefly stated, the recoil brake for controlling recoil and counterrecoil movements of a gun includes a brake cylinder; a piston slidably received therein; a hollow piston rod affixed to the piston and arranged for connection to a breechblock of the gun; a throttle passage for braking the motion of the piston; a buffer spear affixed to an end of the brake cylinder and extending within the hollow piston coaxially therewith; a buffer spear chamber within the piston rod; and a throttle sleeve affixed to the piston and extending therewithin, surrounding the buffer spear. The throttle sleeve and the piston rod define an annular inlet channel, while the throttle sleeve and the buffer spear define an annular outlet channel. A check valve is located between the inlet and outlet channels, and it opens solely in response to pressure in the inlet channel when the piston moves in a direction outwardly of the brake cylinder (recoil movement). An axially extending throttle groove is provided in the outer surface of the buffer spear. Further, there is provided an annular guide which is formed on the throttle sleeve and which surrounds and slidingly contacts the buffer spear. The annular guide cooperates with the throttle groove for forming a constricted passage for the hydraulic fluid as it flows from the buffer spear chamber through the outlet channel to one side of the piston as the piston moves into the brake cylinder (counterrecoil movement). Cross-sectional passage areas of the throttle groove along a length thereof determine the extent and the path length of the braking effect for the counterrecoil movement of the gun.

Thus, according to the invention, the hydraulic fluid is able to be throttled through throttling grooves in the buffer spear during counterrecoil by dividing the braking function for recoil and counterrecoil to mutually independent regions of the recoil brake and by filling the buffer spear chamber directly from a brake chamber. The course of the throttle groove is designed so that it will produce the desired counterrecoil velocity and will be matched to the desired braking force curve. This allows the use of purely pneumatic recuperating mechanisms without throttling devices in tanks and artillery weapons and preferably in those operating with an automatic flow of ammunition such as an armored howitzer.

DESCRIPTION OF THE PREFERRED EMBODIMENT

Figure 1:
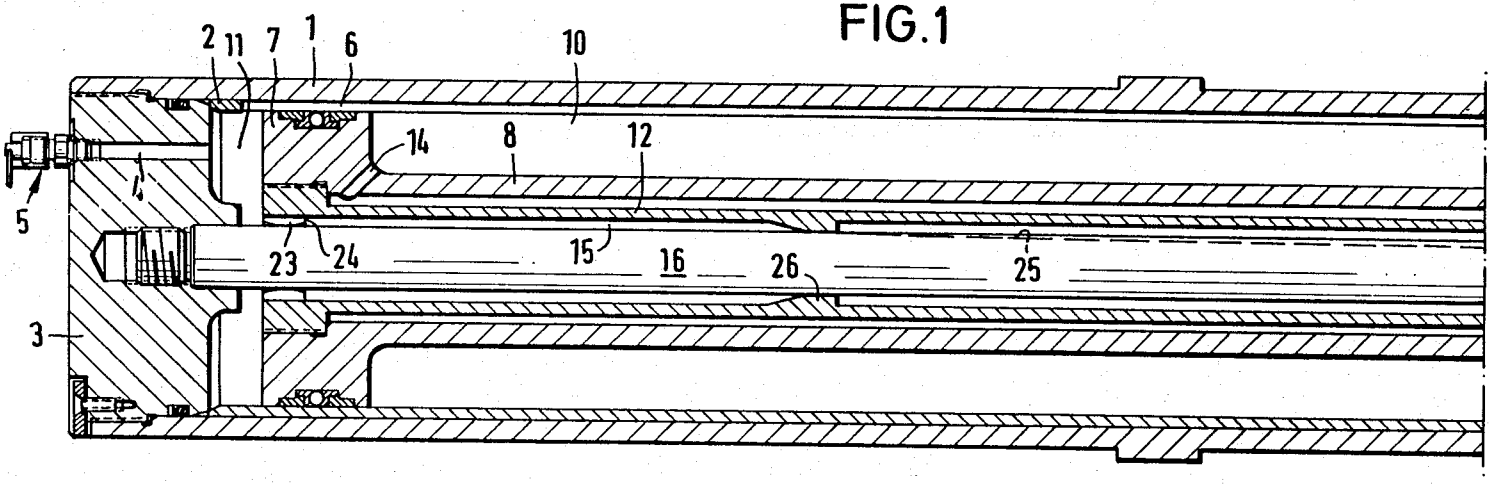
FIGS. 1 and 2 are axial sectional views of a preferred embodiment of the recoil brake according to the invention, respectively showing a first length portion and a continuing second length portion of the construction.
Figure 2:
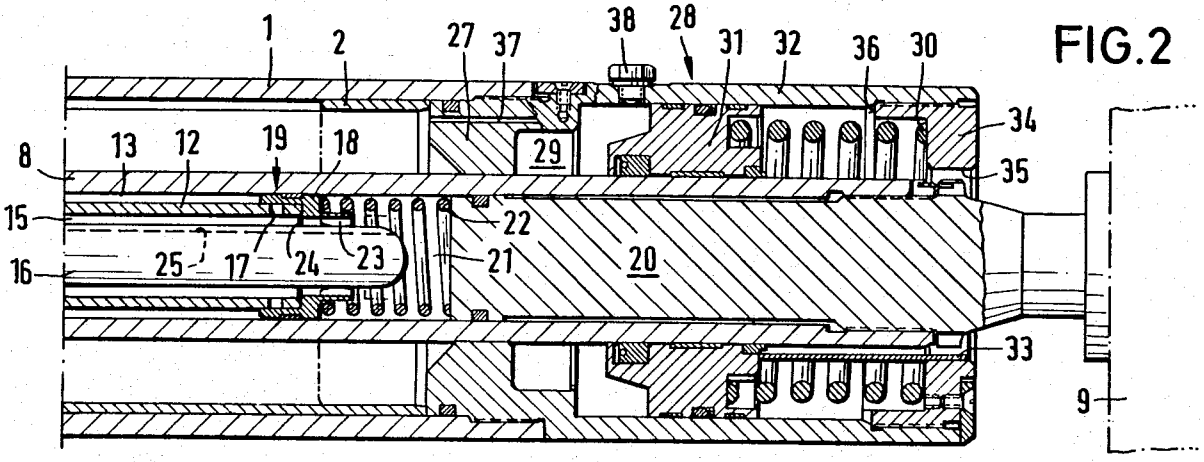

Turning to the two Figures which, when viewed together end-to-end, show the entire single elongated construction, there is illustrated a brake cylinder 1 having a control sleeve 2 that has been inserted so that it lies against the inner wall of the brake cylinder 1. The brake cylinder 1 is closed at its front end by a cap nut 3 that is screwed into the front end. The cap nut 3 is provided with a bore 4 which is closed by an oil filling valve 5. The front of the control sleeve 2 contacts and is supported by the cap nut 3. The control sleeve 2 is provided with at least one axial control groove 6 extending substantially over its entire length. A piston 7 is slidably disposed within the control sleeve 2 and has a hollow piston rod 8. Between the piston rod 8 and the control sleeve 2 a brake chamber 10 is defined which communicates through the control groove 6 with an equalizing chamber 11 disposed between the cap nut 3 and the piston 7.

A throttle sleeve 12 extends over almost the entire stroke length of the piston rod 8. The end of throttle sleeve 12 is threadedly fastened to the front of the piston 7. Between the piston rod 8 and the throttle sleeve 12 there is formed an annular inlet channel 13 which communicates with the brake chamber 10 by means of openings 14 disposed in the region of the piston 7. A buffer spear 16, screwed into the cap nut 3 and having a rounded free end, is disposed axially in throttle sleeve 12 so as to form an annular outlet channel 15 therewith. That end of the throttle sleeve 12 which is oriented toward the breechblock 9 is provided with bores 17 in a circumferential series. This end of the throttle sleeve 12 also supports an annular valve body 18 of a check valve 19 which, in the illustrated starting position of the recoil brake, seals the bores 17 on the exterior side of the throttle sleeve 12.

A coupling member 20 is threadedly inserted into the end of the piston rod 8 remote from the piston 7 for connecting the piston rod 8 with the breechblock 9 of the gun. The coupling member 20 bounds a buffer spear chamber 21 which is constituted within the interior of piston rod 8 by the free space between the free end of the throttle sleeve 12 and connecting member 20. The buffer spear chamber 21 is sealed toward the inlet channel 13 by the valve body 18. The valve body 18 is urged against the free end of throttle sleeve 12 by means of a spring 22 that is supported at the end face of the coupling member 20. The front (cradle-side) end of the throttle sleeve 12 in the region of the piston 7 and the valve body 18 are both provided with substantially hemispherical slide bushing or sleeve guides for the buffer spear 16. The slide bushing guides 24 are interrupted by axial passages 23 which allow fluid to pass through the slide bushing guides 24.

The buffer spear 16 is provided with a throttle groove 25 that extends from the free end of the buffer spear 16 over a substantial part—preferably between $\frac{2}{3}$ and 4/5—of its length. An annular guide bushing 26 is formed on the throttle sleeve 12 and, together with a momentarily aligned portion of the throttle groove 25, constitutes a constricted passage for the fluid flowing between the throttle sleeve 12 and the buffer spear 16. The throttle groove 25 is configured to have a continuously decreasing cross section viewed from its end which is oriented towards the free end of the buffer spear 16. The position of the guide 26 on throttle sleeve 12 and the course of the throttle groove 25 determines the length of the counterrecoil path. If the recoil brake is in the position of rest, the end of the throttle groove 25 stops short of the guide bushing 26.

As the gun is fired, the piston rod 8 is retracted by the breechblock 9 thereby increasing the fluid pressure in brake chamber 10. This causes most of the hydraulic fluid of the brake chamber 10 to flow into an equalizing chamber 11 through the control groove 6 in the control sleeve 2, thus causing steady braking of the recoiling mass of the gun.

As the gun is recoiling, another part of the hydraulic fluid of brake chamber 10 flows through the openings 14 in piston 7 into and through the inlet channel 13 which is between the piston rod 8 and the throttle sleeve 12. From throttle sleeve 12, the fluid forces open the check valve 19 by overcoming the force of spring 22 and flows through the bores 17 into the buffer spear chamber 21. Because of the brake pressure on the hydraulic fluid, the hydraulic fluid fills the buffer spear chamber 21 quickly and completely during recoil.

At the end of the recoil, a recuperator (not shown) pulls the recoiling mass back toward the front (counterrecoil movement), returning it to the firing position. In the firing position, the buffer spear 16 projects into the buffer spear chamber 21 (as shown). During the counterrecoil movement, the hydraulic fluid located in the equalizing chamber 11 flows through the control groove 6 back into the brake chamber 10. As this occurs, the hydraulic fluid in the buffer spear chamber 21 flows back to the equalizing chamber 11 only through a constriction in the buffer spear 16. This constriction is formed by the throttle guide 26 of the throttle sleeve 12 and the throttle groove 25 and is configured so that it is matched to the function of the weapon. Once this fluid has returned to the equalizing chamber 11, it is returned to the brake chamber 10 as described above. This allows a defined counterrecoil braking to be effected independent of the magnitude of the propelling charge employed during firing.

The rear end of the brake chamber 10 adjacent the breechblock 9 is bounded by an impact plate 27 that takes up the braking forces during firing and transfers them to the brake cylinder 1. The impact plate 27 supports one end of the control sleeve 2 and is part of a separate heat equalization and indication device 28. The heat equalization and indication device 28 is connected to the brake cylinder 1 in the region of the impact plate 27 so that the impact plate 27 is coaxial with and screwed to the brake cylinder 1. The heat equalization and indication device 28 also includes a heat equalizing chamber 29 on the side of the impact plate 27 which faces away from brake chamber 10 and is bounded at the other end by a heat equalization piston 31. The heat equalization piston 31 is normally forced in the direction of the impact plate 27 by a spring 30. The heat equalization piston 31 is axially slidable and is sealed against the piston rod 8 which extends through the heat equalization and indication device 28 and is also sealed against an outer cylindrical housing 32.

The heat equalization piston 31 is equipped with an indicator element 33 which moves out of the housing 32 upon a predetermined displacement of the heat equalization piston 31. The spring 30 is supported at the end adjacent the exterior by a closure 34 which is screwed to the housing 32. The closure 34 is provided with a passage opening 35 for the piston rod 8, the connecting member 20, and the indicator element 33, respectively. The closure 34 also includes an abutment 36 which acts as a rear stop for the heat equalization piston 31. The heat equalizing chamber 29 communicates with the brake chamber 10 by a throttle bore 37 which extends through the impact plate 27. The throttle bore 37 is coordinated with the braking function of the recoil brake and prevents the brake pressure from passing into the heat equalization chamber 29 with full force. The tolerances between the piston rod 8 and the impact plate 27 also prevent the brake pressure from passing into the heat equalization chamber 29 with full force. Thus, dependent on the temperature of the hydraulic fluid, the position of the heat equalization piston 31—which equalizes volume changes of the hydraulic fluid in the range of operating temperatures—shows, by means of the indicator element 33, the level of volume and the temperature of the hydraulic fluid in the recoil brake.

A ventilation screw 38 is provided in the housing 32 in the region of the heat equalization chamber 9 to allow air to be removed from the recoil brake when it is filled with hydraulic fluid.

It will be understood that the above description of the present invention is susceptible to various modifications, changes and adaptations, and the same are intended to be comprehended within the meaning and range of equivalents of the appended claims.

What is claimed is:

1. In a recoil brake for controlling recoil and counterrecoil movements of a gun, including a brake cylinder adapted to be filled with hydraulic fluid and having opposite first and second ends;

a piston slidably received in the brake cylinder; said piston separating an inner volume of said brake cylinder into a brake chamber and an equalizing chamber;

a hollow piston rod affixed to said piston and extending axially through said brake chamber towards said second end and being arranged for connection to a breechblock of the gun at said second end;

a throttle passage maintaining hydraulic communication between said brake chamber and said equalizing chamber across said piston for driving hydraulic fluid by said piston in a throttled flow between the brake chamber and the equalizing chamber;

a buffer spear having an end affixed to said first end of said brake cylinder and an opposite, free end; said buffer spear projecting through said piston into said hollow piston rod and extending coaxially therewith; and means defining a buffer spear chamber within said piston rod for receiving the free end of said buffer spear when said piston is situated adjacent said first end of said brake cylinder;

the improvement comprising (a) a throttle sleeve affixed to said piston and extending within said piston rod coaxially therewith and surrounding said buffer spear; said throttle sleeve and said piston rod defining an annular inlet channel; said throttle sleeve and said buffer spear defining an annular outlet channel being in hydraulic communication with said equalizing chamber at one end and with said buffer spear chamber at an opposite end;

(b) a port provided in said piston and arranged for maintaining hydraulic communication between said inlet channel and said brake chamber;

(c) a check valve between said inlet and outlet channels at said buffer spear chamber; said check valve being arranged to open solely in response to pressure in said inlet channel when said piston moves towards said second end of said brake cylinder;

(d) a throttle groove provided in said buffer spear and extending therealong from the free end thereof; and (e) an annular guide formed on said throttle sleeve and surrounding and slidingly contacting said buffer spear; said annular guide cooperating with said throttle groove for forming a constricted passage for the hydraulic fluid from said buffer spear chamber into said equalizing chamber through said outlet channel as said piston moves towards said first end of said brake cylinder; cross-sectional passage areas of said throttle groove along a length thereof determining an extent and path length of braking the counterrecoil movement of the gun.

2. A recoil brake as defined in claim 1, wherein said check valve includes means for centering an end of said throttle sleeve in said piston rod.

3. A recoil brake as defined in claim 1, wherein said cross-sectional passage areas of said throttle groove continuously decrease as viewed from said free end of said buffer spear.

4. A recoil brake as defined in claim 1, wherein said buffer spear has a length measured from said free end thereof to said first end of said brake cylinder, and further wherein said throttle groove extends over at least two thirds of the length of said buffer spear.

5. A recoil brake as defined in claim 4, wherein said throttle groove extends over at most four-fifths of the length of said buffer spear.

6. A recoil brake as defined in claim 1, wherein said check valve includes a valve body containing a bearing portion forming a bearing surface for said buffer spear; further comprising a spring disposed in said buffer spear chamber and arranged for urging said valve body in a valve-closing position.

7. A recoil brake as defined in claim 6, wherein said check valve includes fluid communication bores provided in said throttle sleeve and being covered or uncovered by said valve body dependent on the direction of motion of said piston.

8. A recoil brake as defined in claim 6, wherein said valve body includes flow passages maintaining said hydraulic communication between said annular outlet channel and said buffer spear chamber.

* * * * *